United States Patent [19]

Braber et al.

[11] 3,979,020

[45] Sept. 7, 1976

[54] ARTICLE DISPENSING CONTAINER

[76] Inventors: Robert J. Braber, P.O. Box 568; Paul L. Weber, 50 Connecticut Drive, both of Burlington, N.J. 08016

[22] Filed: July 21, 1975

[21] Appl. No.: 597,370

Related U.S. Application Data

[63] Continuation of Ser. No. 420,605, Nov. 30, 1973, abandoned.

[52] U.S. Cl. ..... 221/63

[51] Int. Cl.[2] ..... B65H 1/00

[58] Field of Search ..... 220/315, 337, 339, 340, 220/341, 16; 229/44 R; 221/33, 62, 63, 47, 48, 34–46, 49–54, 56–61; 156/242; 150/0.5

[56] References Cited

UNITED STATES PATENTS

| | | | |
|---|---|---|---|
| 3,315,718 | 4/1967 | Berman | 150/0.5 |
| 3,552,595 | 2/1969 | Gerner et al. | 220/16 |
| 3,780,908 | 12/1973 | Fitzpatrick et al. | 221/48 |
| 3,784,055 | 1/1974 | Anderson | 221/46 |

*Primary Examiner*—Allen N. Knowles
*Assistant Examiner*—Norman L. Stack, Jr.
*Attorney, Agent, or Firm*—Robert K. Youtie

[57] ABSTRACT

A dispensing container and method of manufacture wherein a pair of hollow parts are nested and a closure is secured across the hollow of the inner nested part, the outer nested part being swingably connected to define a hinged cover.

7 Claims, 7 Drawing Figures

FIG. 1
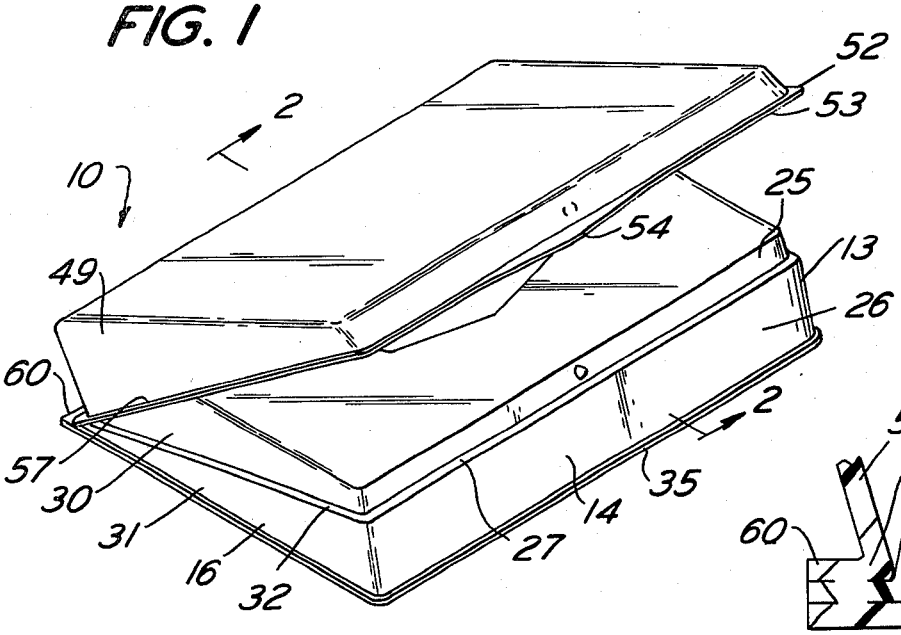
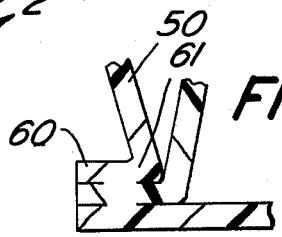
FIG. 4
FIG. 2
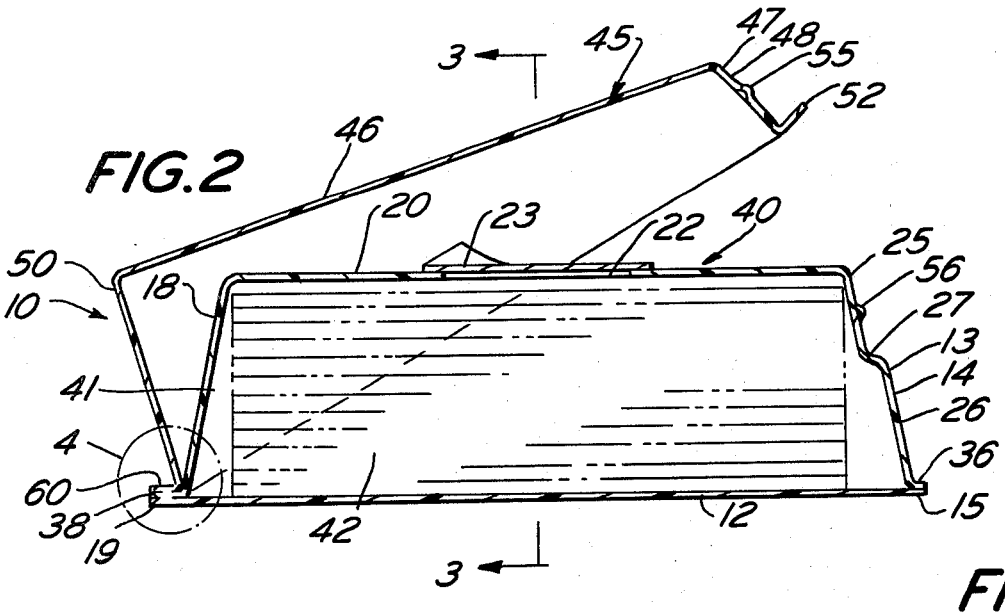
FIG. 3
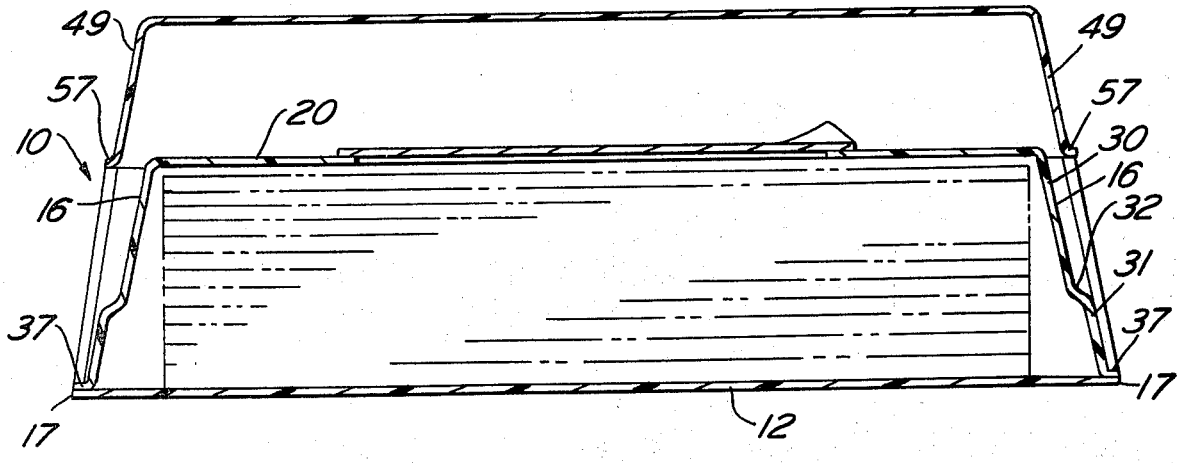

ARTICLE DISPENSING CONTAINER

CROSS-REFERENCES TO RELATED APPLICATIONS

This is a continuation application of our copending patent application Ser. No. 420,605, filed Nov. 30, 1973, now abandoned entitled DISPENSING CONTAINER AND METHOD OF MANUFACTURE, now abandoned.

BACKGROUND OF THE INVENTION

While the packaging method and container of the present invention have been primarily developed and employed for use in conjunction with contents having moist or liquid characteristics, and will be illustrated and described hereinafter with particular reference thereto, it is appreciated that the invention is capable of many varied applications all of which are intended to be comprehended herein.

Heretofore, in the packaging of liquids or liquid containing contents for dispensing from the package, considerable problems were encountered both in the manufacturing methods or packaging procedures, and also in the use or dispensing operation of the package. In particular, difficulties were encountered in the handling of liquid or liquid containing materials during the filling or packaging operation, maintaining the packaged materials against deterioration during storage, transit and shelf life, and also in maintaining neatness during dispensing or removal of the contents while guarding against evaporation or other damage to the goods.

SUMMARY OF THE INVENTION

It is among the objects of the present invention to provide a highly improved dispensing container and method of manufacturing the same which overcome the above-mentioned difficulties, permit of quick, easy and economical manufacture and filling, safeguard the contents against deterioration for an indefinite period ample to assure preservation of the contents through storage, shipment and more than average shelf life, and which further serves to enhance the quality of the product even after initial opening of the container and during depletion of the contents by use thereof.

It is another object of the present invention to provide a container of uniquely improved construction and a method of manufacturing the same, wherein are effected substantial economies both in materials and production costs, and which result in container construction of staunchness and durability for a long useful life without leakage or other defects, and further wherein is adapted to be produced containers of uniquely attractive appearance for high receptivity at the point of sale.

Other objects of the present invention will become apparent upon reading the following specification and referring to the accompanying drawings, which form a material part of this disclosure.

The invention accordingly consists in the features of construction, combinations and arrangements of parts and method steps, which will be exemplified in the following description, and of which the scope will be indicated by the appended claims.

BRIEF DESCRIPTION OF THE DRAWINGS

FIG. 1 is a top perspective view showing a dispensing container constructed in accordance with the teachings of the present invention, illustrating the cover in a partially open condition.

FIG. 2 is a transverse sectional elevational view taken generally along the line 2—2 of FIG. 1.

FIG. 3 is a longitudinal sectional elevational view taken generally along the line 3—3 of FIG. 2.

FIG. 4 is a fragmentary enlarged sectional elevational view showing the area designated 4 of FIG. 2.

DESCRIPTION OF THE PREFERRED EMBODIMENT

Figure 5:
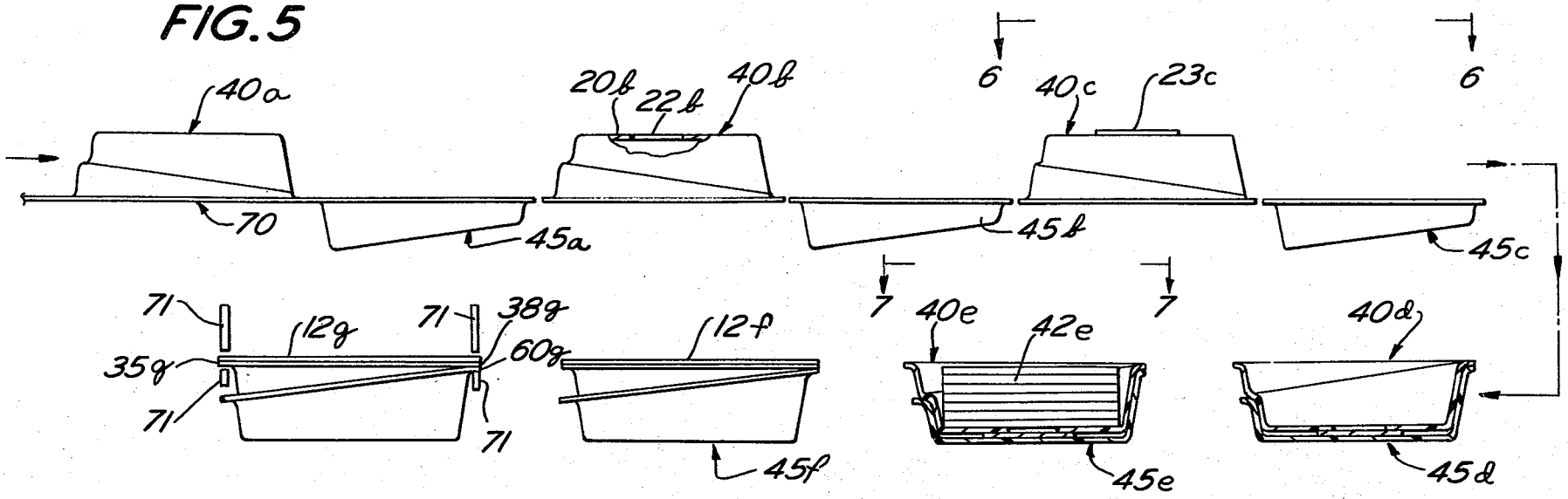
FIG. 5 is a diagrammatic representation illustrating in elevation and partly in section the method of the instant invention.

Referring now more particularly to the drawings, and specifically to FIGS. 1–3 thereof, a dispensing container constructed in accordance with the teachings of the present invention is there generally designated 10, and is advantageously, but not necessarily, entirely fabricated of plastic sheet material, as illustrated. For example, the fabrication may be by thermoforming of sheet vinyl, or otherwise forming suitable material, say styrene, or the like.

The container 10 may include a generally flat bottom wall 12, say of an impervious, generally rectangular sheet. An upstanding, peripheral wall 13 is provided on the bottom wall 12, extending circumferentially thereabout, say including an upstanding front section 14 upstanding from the bottom wall 12 along the forward edge 15 of the bottom wall, a pair of upstanding side sections 16 extending rearwardly from opposite ends of the front wall section 13 along respective side edges 17 of the bottom wall, and a rear or back section 18 extending between the rearward regions of side sections 16 and upstanding along the rear edge 19 of the bottom wall. A generally rectangular, normally horizontally disposed top wall 20 is disposed in parallel spaced superposed relation over the bottom wall 12, extending between and integral with upper regions of the peripheral side wall 13. Thus, the top wall 20 and its peripheral side wall 13 may be integrally fabricated, say be thermoforming, of a single sheet of thermoplastic material.

The top wall 20 may be formed with a central through opening or hole 22, defining an outlet or dispensing passageway for contents, as will appear presently. A removable closure or seal 23 may be adhesively or otherwise suitably secured to the top wall 20 in closing relation with respect to the outlet opening 22. The upstanding front wall section 14 may have its upper portion 25 offset inwardly or rearwardly with respect to its lower portion 26, as by a generally horizontal offsetting portion or shelf 27 extending generally horizontally between side wall sections 16 and spaced vertically between the lower and upper extremities of the front wall section. In addition, each side wall section 16 may have its upper region 30 offset laterally inwardly with respect to its lower region 31, as by an intermediate offsetting region or shelf 32. The shelf 32 of each side wall section 16 may extend therealong, generally obliquely downwardly between the front wall section 14 and the rear wall section 18. Thus, the offsetting portions or shelves 32 each extend generally rearwardly from a coplanar relation with a respective end of front wall section shelf 27, thence obliquely rearwardly and downwardly terminating at the rear end of the respective side wall section 16, adjacent to the lower extremity thereof.

Extending peripherally about the lower extremity of the entire upstanding peripheral side wall 13 is an outwardly projecting circumferential flange 35 seated on the upper surface of bottom wall 12 entirely about the peripheral margin of the latter. In particular, the circumferential flange 35 may be considered as composed of a front flange section 36 projecting forwardly from the lower extremity of front wall section 14, side flange sections 37 projecting laterally outwardly from respective side wall sections 16, and a rear flange section 38 projecting rearwardly from the lower extremity of the rear wall section 18. The front, side and rear flange sections 36, 37 and 38 are all integrally connected together in end-to-end relation to define a continuous circumferential flange 35.

Thus, it will be appreciated that the top wall 20 and peripheral wall 13, with its circumferential flange 35 combine to define a hollow part, generally designated 40, with its interior hollow 41 facing generally downwardly and closed by extension across its lower side of the bottom wall 12. Further, the flange 35 is suitably secured in sealed relation to the bottom wall, say by thermoplastic welding, advantageously of the radio-frequency type.

Interiorly of the hollow 41, as between the hollow part 40 and its bottom closure 12, there may be located a desired contents, as at 42. The contents may be of interleaved, stacked, paper washcloths, or the like, impregnated with soap and water, or otherwise. The interior hollow or chamber 41 is entirely sealed in fluid-tight relationship, as by the sealing of flange 35 to bottom wall 12, and the closure sheet 23, to afford highly effective protection to such contents.

A hollow, downwardly facing or concave cover is generally designated 45, and engaged in receiving relation over the hollow part 40. Specifically, the cover 45 may also be advantageously fabricated of a single integral piece, say by thermoforming of plastic sheeting, and may include a generally flat upper wall 46, say of rectangular or other suitable configuration say to comfortably overlie the top wall 20. Extending entirely about the circumference of and depending from the upper wall 46 is a peripheral side wall 47. The depending peripheral side wall 47 may be composed of a front wall section 48 depending from the forward edge of upper wall 46, a pair of side wall sections 49 depending from opposite sides or lateral edges of upper wall 46, extending rearwardly from opposite ends of the front wall section 48, and a rear wall section 50 depending from the rear edge of upper wall 46 and extending laterally between opposite side wall sections 49. With the upper wall 46 of cover 45 resting on the top wall 20, the front depending wall section 48 depends generally to the shelf or land 27 so as to overlie the upper portion 25 of the upstanding front wall section 14. In this overlying or closed cover position, the depending side wall sections 49 depend generally to respective adjacent lands or shelves 32, being configured to substantially comformably overlie respective adjacent upper side wall sections 30. The upstanding rear wall section 18 may be generally planar, and the depending rear wall section 50 may be generally planar in conforming engagement with the upstanding rear wall section.

Extending entirely about the lower extremity or circumferential edge of depending peripheral side wall 47 is a circumferential, outwardly projecting flange or lip 52. The circumferential flange or lip 52 includes a front lip or flange section 53 projecting from the lower edge of front depending peripheral side wall section 47 overlying the shelf 27 when the cover is closed. Also, the front flange or lip section 53 may have a central tab or fingerpull extension 54, to facilitate manipulation. Formed in both the depending peripheral side wall front section 48 and the upper part 25 of upstanding peripheral side wall front section 14 may be releasably interfitting formations, such as hollow protuberances 55 and 56. These formations 55 and 56 snap engage and disengage upon cover closure and opening to releasably retain the cover closed. If desired, the hollow formation 55 may protrude inwardly rather than outwardly, and be located to pass over and beyond the formation 56. Other suitable cover retaining means may be employed, if preferred.

The circumferential cover flange 52 further includes a pair of side flange sections 57 projecting outwardly from the lower extremities of respective cover side wall sections 49 and overlying adjacent shelves 32 when the cover is closed. Additionally, the circumferential flange or lip 52 includes a rear lip section or flange 60, which may be of greater width than the flange sections 53 and 57, and serves, as will appear presently, to define a hinge. That is, the rear flange section 60 overlies the flange section 38 of part 40 and the rear edge margin 19 of bottom wall 12, the lamination or securement together of these three overlying layers 60, 38 and 19 being suitably accomplished, as by thermoplastic welding, preferably of the radio-frequency type. In this manner, the cover 45 is mounted for relative swinging movement, say about the juncture of hinge flange 60 with rear depending peripheral side wall section 50, as at 61. More particularly, the inherent resilience of the plastic sheet material permits of upward and outward swinging movement of cover 45, say counterclockwise as seen in FIG. 2 to expose top wall 20 and present sticker seal 23 for convenient manufal access. The sticker patch or seal 23 may be permanently or temporarily removed, and the contents 42 withdrawn upwardly and outwardly through opening or passageway 22. Upon release of the cover 45, the inherent resilience of the cover material, and particularly of the flexed juncture or joint 61, serves to swing the cover back toward its closed position. With the cover 45 fully closed, the patch 23 having been removed and the formations 55 and 65 snap engaged, the cover top wall 46 closely overlies the nether top wall 20 in closing relation with the top wall opening or hole 22 so as to effectively preserve the liquid contents from evaporation throughout a normal period of use.

Figure 7:
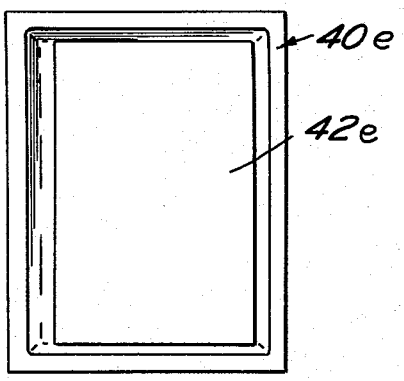
FIG. 7 is a partial plan view taken generally along the line 7—7 of FIG. 5.
Figure 6:
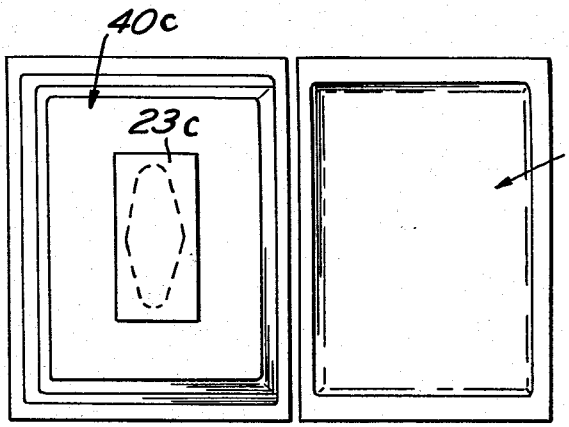
FIG. 6 is a partial plan view taken generally along the line 6—6 of FIG. 5.

Considering now the method of the instant invention as shown in FIGS. 5–7, a web or sheet 70 is thermoformed, say upwardly to form of the web material a downwardly facing hollow part 40*a* corresponding to the hereinbefore described hollow part 40. Also formed, say of the same thermoplastic sheet 70, may be a depressed, upwardly hollow formation or part 45*a* corresponding to the hereinbefore described cover 45. The hollow thermoformed parts 40*a* and 45*a* may pass to a cutting station, rightward in FIG. 5, being severed from the web and forming separate hollow parts 40*b* and 45*b*. At this station the hollow part 40*b* may have its top wall 20*b* cut to form a through passageway or opening 22*b*.

Further downstream along the production line, a sealing sticker, patch or label 23*c* may be applied to the hollow part 40*c*, and at the next station the hollow part 40*d* may be inverted to an upwardly facing condition and engaged in nesting relation in an upwardly facing outer part 45*d*.

In this condition, contents 42*e* may be deposited in the upwardly facing hollow of inner nexted part 40*e*, which remains nested in outer part 45*e*.

Downstream of the filling station, a bottom wall or closure 12*f* is placed on and extending entirely across and in closing relation with respect to the hollow inner nested part 40*f*, which remains nested in the outer part 45*f*. This serves to totally enclose the previously deposited contents.

A later step is that of securing together the circumferential flange 35*g* in its facing engagement with the peripheral margin of bottom wall or closure 12*g*, and simultaneously securing the hinge flange 60*g* to the rear flange section 38*g* of circumferential flange 35*g*. This may be accomplished by suitable dies 71 having radio-frequency energy means associated therewith in the conventional manner.

From the die means 71, there may be removed a finished package 10 as described in connection with FIGS. 1–4. Of course, suitable printing, decorating and the like may be employed, as desired.

If preferred, the parts 40*a* and 45*a* may be thermoformed in sheet 70 with part 40*a* facing upwardly and part 45*a* facing downwardly. The part 45*a* may then be swung into upwardly facing position beneath and receiving the part 40*a*. Also, the parts 40*a* and 45*a* need not be entirely cut apart, but may remain tagged or connected by flexible strips or tabs throughout the procedure, if desired.

From the foregoing, it is seen that the present invention provides a dispensing container and method of manufacture which are extremely simple in structure and procedure, so as to effect substantial savings in cost while providing a package which is uniquely attractive in appearance, greatly improved functionally, reliable in operation throughout a long useful life, and which otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A fluid sealed dispensing container fabricated entirely of thermoplastic sheet material and comprising a generally flat bottom wall, a separate upstanding peripheral side wall upstanding entirely about the periphery of said bottom wall spaced inwardly from the circumference thereof, an outstanding circumferential flange extending entirely about said side wall integral therewith and sealed thereabout in fluid-tight downwardly facing relation to the circumferential margin of said bottom wall, a generally flat top wall spaced over said bottom wall and integral with the upper extremity of said side wall entirely about the latter and combining with said side and bottom walls to define a fluid sealed contents holding space, said top wall having a through opening for outwardly passing contents, a closure patch removably secured to said top wall in moisture-proof closing relation with said opening, a separate cover overlying said top wall, and a resiliently flexible hinge flange extending outwardly from said cover integrally therewith and fixedly secured relative to said top wall to mount said cover resiliently urged toward said overlying relation.

2. A dispensing container according to claim 1, said hinge flange overlying said circumferential flange at the seal thereof and being sealed thereto to define a three layer laminate.

3. A dispensing container according to claim 1, said cover closely overlying said top wall in closing relation with said opening.

4. A dispensing container according to claim 3, said hinge flange overlying said circumferential flange at the seal thereof and being sealed thereto to define a three layer laminate.

5. A fluid sealed dispensing container according to claim 4, said peripheral wall including spaced front and rear portions and a pair of side portions extending between said front and rear portions, said cover including a depending front section overlying said front portion, a pair of depending side sections overlying said depending side portions, and a rear section overlying said rear portion and carrying said hinge flange.

6. A fluid sealed dispensing container according to claim 5, said rear section entirely overlying said rear portion, and said side and front sections partially overlying said side and front portions.

7. A dispensing container according to claim 6, the under regions of said side and front portions being offset inwardly to receive said side and front sections.

* * * * *